US005135427A

United States Patent [19]

Suto et al.

[11] Patent Number: 5,135,427

[45] Date of Patent: Aug. 4, 1992

[54] CATERPILLAR-TYPE VEHICLE TOY

[75] Inventors: Shohei Suto, Tokyo, Japan; Neil Tilbor, Medford; Warren E. Bosch, Burlington, both of N.J.

[73] Assignee: Tyco Industries, Inc., Mount Laurel, N.J.

[21] Appl. No.: 759,250

[22] Filed: Sep. 13, 1991

Related U.S. Application Data

[63] Continuation-in-part of Ser. No. 728,671, Jul. 12, 1991.

[30] Foreign Application Priority Data

Jan. 22, 1991 [JP] Japan ..... 2-5699

[51] Int. Cl.[5] ..... A63H 17/14; A63H 30/04; A63H 17/26; B62D 11/02

[52] U.S. Cl. ..... 446/433; 446/456; 446/470; 180/6.7

[58] Field of Search ..... 446/433, 434, 454, 456, 446/457, 461, 462, 463, 466, 470; 180/6.54, 6.7, 9, 9.1, 9.46, 9.62, 9.64, 10

[56] References Cited

U.S. PATENT DOCUMENTS

| | | | |
|---|---|---|---|
| Des. 139,803 | 12/1944 | Henry | D21/131 |
| Des. 219,287 | 11/1970 | Rosenthal | D21/131 |
| Des. 232,573 | 8/1974 | Daniel | D21/131 |
| Des. 236,642 | 9/1975 | Fahrendorff | D21/131 |
| Des. 252,228 | 6/1979 | Asano | D21/131 |
| Des. 252,231 | 6/1979 | Asano | D21/131 |
| Des. 252,291 | 7/1979 | Asano | D21/131 |
| Des. 289,187 | 4/1987 | Ohno | D21/131 |
| Des. 313,255 | 12/1990 | Honma | D21/137 |
| Des. 313,823 | 1/1991 | Scheckel | D21/128 |
| Des. 317,024 | 5/1991 | Yajima | D21/137 |
| Des. 317,336 | 6/1991 | Tsuchiya | D21/137 |
| Des. 318,081 | 7/1991 | Yoshino | D21/137 |
| Des. 318,888 | 8/1991 | Yoshino | D21/137 |
| 1,319,998 | 10/1919 | Glinka | 305/35 EB |
| 1,592,559 | 7/1926 | Dean | 446/433 |
| 1,669,345 | 5/1928 | Owens | 180/9.46 |
| 1,748,400 | 3/1929 | Sabin | 254/321 |
| 2,244,528 | 6/1941 | Schur | 446/433 |
| 2,279,386 | 4/1942 | Carver | 446/433 |
| 2,320,019 | 5/1943 | Van Voorhis | 180/9.64 |
| 2,586,239 | 2/1952 | MacKenzie | 446/427 |
| 2,778,158 | 1/1957 | Ernst | 446/433 |
| 2,832,426 | 4/1958 | Seargeant | 446/454 X |
| 2,898,965 | 8/1959 | Eddy | 152/175 |
| 3,120,409 | 2/1964 | Beall | 305/13 |
| 3,190,384 | 6/1965 | Dufresne | 180/6.7 |
| 3,351,037 | 11/1967 | Meili | 180/6.7 X |
| 3,447,620 | 6/1969 | Schoonover | 180/9.64 X |
| 3,521,527 | 7/1970 | Gies et al. | 71/1 |
| 3,688,858 | 9/1972 | Jesperson | 180/9.62 |
| 3,695,736 | 9/1972 | Brown | 280/28.5 X |
| 3,726,355 | 4/1973 | Dunder | 180/5 R |
| 3,747,265 | 7/1973 | Gagnon | 446/425 |
| 3,772,825 | 11/1973 | Gagnon | 446/425 |
| 3,810,515 | 5/1974 | Ingrow | 446/177 X |
| 3,823,790 | 7/1974 | Richison et al. | 180/6.7 |
| 3,869,825 | 3/1975 | Heberlein | 446/433 |
| 4,017,746 | 4/1989 | Purcell et al. | 180/6.7 X |
| 4,198,103 | 4/1980 | Ward et al. | 384/226 |

(List continued on next page.)

*Primary Examiner*—David N. Muir
*Attorney, Agent, or Firm*—Schwarze Panitch

[57] ABSTRACT

A vehicle toy has front wheels and larger rear wheels provided on each of the left and right sides of a two-piece, articulately coupled chassis. Caterpillars are engaged over the front and rear wheels on each side. Twin electric motors separately drive the left and right side caterpillars through separate reduction gear transmissions and the rear wheels. The twin motors are radio controlled for separate and independent operation. Two rings of teeth on each rear wheel mesh with two rows of teeth on the inner side of each caterpillar to provide a cog drive while a higher central row of teeth on the inner side of each caterpillar is received in circumferential grooves in each of the front and rear wheels. The separate reduction gear transmissions are simultaneously manually shiftable between high and low gear ratios to provide the vehicle with the ability to run at a high speed comparable to that of other radio-controlled, wheeled vehicle toys without caterpillars and at a lower speed for longer battery life with increased torque.

19 Claims, 5 Drawing Sheets

U.S. PATENT DOCUMENTS

| | | | |
|---|---|---|---|
| 4,231,182 | 11/1980 | Kurita | 446/433 |
| 4,306,630 | 12/1981 | Monte et al. | 180/157 |
| 4,458,444 | 7/1984 | Avery et al. | 446/433 |
| 4,483,407 | 11/1984 | Iwamoto et al. | 180/6.54 X |
| 4,522,606 | 6/1985 | Goldfarb et al. | 446/433 |
| 4,591,347 | 5/1986 | Goldfarb et al. | 446/462 |
| 4,597,744 | 7/1986 | Rehkemper et al. | 446/278 |
| 4,739,852 | 4/1988 | Stevens et al. | 180/701 |
| 4,938,483 | 7/1990 | Yavetz | 273/311 |

FOREIGN PATENT DOCUMENTS

| | | | |
|---|---|---|---|
| 1536228 | 5/1929 | Australia . | |
| 104437 | 5/1966 | Denmark | 305/35 EB |
| 631777 | 6/1936 | Fed. Rep. of Germany | 446/433 |
| 499974 | 3/1919 | France . | |
| 2-74476 | 3/1990 | Japan . | |
| 216100 | 3/1924 | United Kingdom . | |
| 459534 | 1/1937 | United Kingdom . | |
| 2104015 | 3/1983 | United Kingdom . | |

OTHER PUBLICATIONS

1986 Tyco catalog pages (cover page and pages 16, 17, 46, 47, 58–69).

1987 Tyco catalog pages (cover page and pages 3–7 and 10–17).

Tyco Spring 1988 catalog pages (cover page and pp. 18–33, 40, 41,50–55, 66, 67).

Tyco Spring 1989 catalog pages (cover page and index page and pp. 4–27, 46–49, 52, 53, 57–59).

Tyco Toys Spring 1990 catalog pages (cover page, index page and pp. 4, 5, 8–23, 44, 45).

Nikko America Inc. 1985 Product Catalog pages (cover and contents pages and pp. 7 and 8).

Nikko America Inc. 1986 Product Catalog pages (front and back covers, contents page and pages 2 and 19 through 22).

Nikko Catalog 1988 pages (front cover, contents page and pages 3–17 and 26–31).

Nikko T E C 1989 catalog pages (front cover, contents page and pp. 1–8, 14–17, and 22–24).

Nikko '89 Catalog pages (cover page, contents page and pp. 8–15, 20, 21 and back cover).

Nikko T E C 1990 catalog pages (cover page, contents page, pages 2–5, 11–14, 17).

Cox 1979 Product Catalog pages (cover page, contents page and pp. 16–19).

Cox Power '76 catalog pages (cover page and pages 2, 40, 42, 43 and back cover page), Cox 1978 "Move Up With Cox", catalog pages (cover page, and pages 13, 14 and 17).

MRC–Tamiya R/C Off–Road Buggies catalog pages (4, 5, 8–11).

Shinsei–The Formula for Excitement catalog pages (cover page (2 sheets) and 4 pages).

New Bright catalog pages (cover page, 2–page price list/order form and page 44).

Page from unidentified Jul. 1989, magazine showing radio–controlled toy tank chassis mounting customized aerodynamically styled body.

CATERPILLAR-TYPE VEHICLE TOY

FIELD OF THE INVENTION

The present invention relates to vehicle toys which can run on a bad-road or an off-road surface or the like, and in particular, to track-laying, off-the-road vehicle toys.

BACKGROUND OF THE INVENTION

It is generally known in the toy field that remote-controlled vehicles such as cars and the like are controlled by signals to connect or disconnect a driving motor. There are various remote-controlled products, including radio-controlled toys, which can run on or off roads or other paved surfaces. These products are roughly divided into two types, namely, four-wheel-drive vehicles (4WD), in which all four wheels of the vehicles are driven, and tanks or like vehicles which are provided with caterpillars with eight or more wheels which support the vehicle on the caterpillars on the ground.

Four-wheel drive vehicles can run at a high speed because the power of the driving motor or motors can be applied directly to the four wheels which can be keyed to their drive shafts. However, such cars have the disadvantages that they can become stuck because the wheels can sink in soft places or they can slip in sandy or grassy places. Also the four-wheel-drive mechanisms with steering are typically complicated and lose significant amounts of the power being transferred from the motor(s) to the wheels.

On the other hand, vehicle toys such as tanks and the like, which are provided with caterpillars, have excellent ability to run the whole length of unpaved, off-road surfaces, including sand and grass. This ability, however, has been designed for relatively low-speed running compared to the speed of comparable four-wheel-drive and two-wheel-drive vehicles.

It would be desirable to provide a vehicle toy capable of high-speed operation at least like that of the best conventional four-wheel-drive vehicle toys, without the complicated drive, and with the advantages offered by other vehicle toys such as tanks with caterpillars, which have a simple structure and can run off roads such as in sand, grass, and the like, without sticking or getting stuck.

SUMMARY OF THE INVENTION

In a first aspect, the invention is a toy vehicle comprising a vehicle chassis having separate front and rear portions and having right and left sides; right and left front wheels mounted on said chassis front portion; right and left rear wheels mounted on said chassis rear portion; and right and left caterpillars each engaged over said front and rear wheels respectively on said right and left sides, said chassis being supported by said right and left front and rear wheels and caterpillars. The toy vehicle further comprises first and second motors driving each of said right and left caterpillars independently of one another through said wheels and an articulate coupling between said front and rear chassis portions providing at least some pivotal movement of said front and rear chassis portions with respect to one another while said vehicle toy is being operated.

In another aspect, the invention is a vehicle toy comprising a vehicle chassis having a front and a rear and right and left sides; right and left front wheels mounted on the chassis; right and left rear wheels mounted on the chassis; and right and left caterpillars each engaged over the front and rear wheels respectively on the right and left sides, the vehicle chassis being supported on the right and left front and rear wheels and caterpillars. The vehicle toy further comprises first and second motors each drivingly coupled respectively to one of the right wheels and one of the left wheels; each of said drivingly coupled right and left wheels include two sections of peripheral projecting teeth spaced apart axially with a circumferential groove between said two sections of teeth; and each caterpillar including an inner circumferential surface, two laterally spaced-apart rows of internal teeth projecting from said internal circumferential surface, said two rows of teeth being spaced to engage said peripheral teeth of said two spaced-apart sections of said drivingly coupled wheel, and a third row of internal teeth projecting from said inner circumferential surface between said two spaced-apart rows of internal teeth, said internal teeth of said third row engaging in said groove of said drivingly coupled wheel.

In another aspect, the invention is a vehicle toy comprising a vehicle chassis having a front and a rear and right and left sides; first and second motors; right and left rear wheels mounted on said chassis respectively drivingly coupled with said first and second motors to be separately driven thereby. Each rear wheel includes peripherally projecting teeth. The vehicle further comprises right and left front wheels rotatably mounted on said chassis; right and left caterpillars respectively engaged over said right front and rear wheels and over said left front and rear wheels. Said chassis is supported on said right and left front and rear wheels and caterpillars. Each of said caterpillars have internal teeth-like projections extending from an inner circumferential surface of said caterpillar and engaging with said peripheral teeth on said rear wheel; and said rear wheels are larger in diameter than said front wheels.

In yet another aspect, the invention is a vehicle toy comprising a vehicle chassis having a front and a rear and right and left sides; right and left front wheels mounted on said chassis; right and left rear wheels mounted on said chassis; right and left caterpillars each engaged over said front and rear wheels respectively on said right and left sides, said chassis being supported on said right and left front and rear wheels and caterpillars; first and second motors respectively separately drivingly coupled through said wheels with said right and left caterpillars to separately drive each of the caterpillars independently of the other. Each of said caterpillars includes a plurality of substantially identically sized, shaped and spaced, generally parallel members projecting from an outer circumferential surface of each caterpillar, each projecting member varying in length across the caterpillar, the length of each member diminishing proximal each of a pair of opposing sides of said outer circumferential surface.

In yet another aspect, the invention is a vehicle toy comprising a vehicle chassis having right and left sides and separate front and rear portions articulately coupled together, said first and second motors respectively separately drivingly coupled to a right side drive shaft and a left side drive shaft. Right and left rear wheels are mounted respectively on said right and left side drive shafts to be separately driven thereby. Each of said rear wheels include two axially spaced-apart sections cf peripheral teeth and a circumferential groove between said teeth sections. Right and left front wheels are rotatably mounted on said vehicle chassis front portion, each front wheel including a centrally located circumferential groove. Right and left caterpillars are respectively engaged over said right front and rear wheels and over said left front and rear wheels. Each of said caterpillars have internal teeth-like projections including two rows of laterally spaced apart teeth circumferentially engaging with said peripheral teeth on said rear wheels and a third row of teeth projecting higher from between said two laterally spaced-apart rows of teeth. Teeth of said third row are received in said grooves of said engaged front and rear wheels. Said chassis is supported for running solely by said right and left front and rear wheels and caterpillars. Said rear wheels are larger in diameter than said front wheels. A radio receiver is mounted in said vehicle to receive a radio-control signal from a separate transmitter unit located remotely from said vehicle. Two motor-driving circuits are connected respectively to said first and second motors. Circuitry is coupled with said radio receiver and configured to produce from said radio control signal separate motor-control signals for each of said motor-driving circuits to separately and independently control said first and second motors.

BRIEF DESCRIPTION OF THE DRAWINGS

The foregoing summary, as well as the following detailed description of the presently preferred embodiments of the invention, will be better understood when in conjunction with the appended drawings, it being understood, however, that this invention is not limited to the precise arrangements illustrated in the drawings.

DETAILED DESCRIPTION OF THE PREFERRED EMBODIMENT

Figure 1:
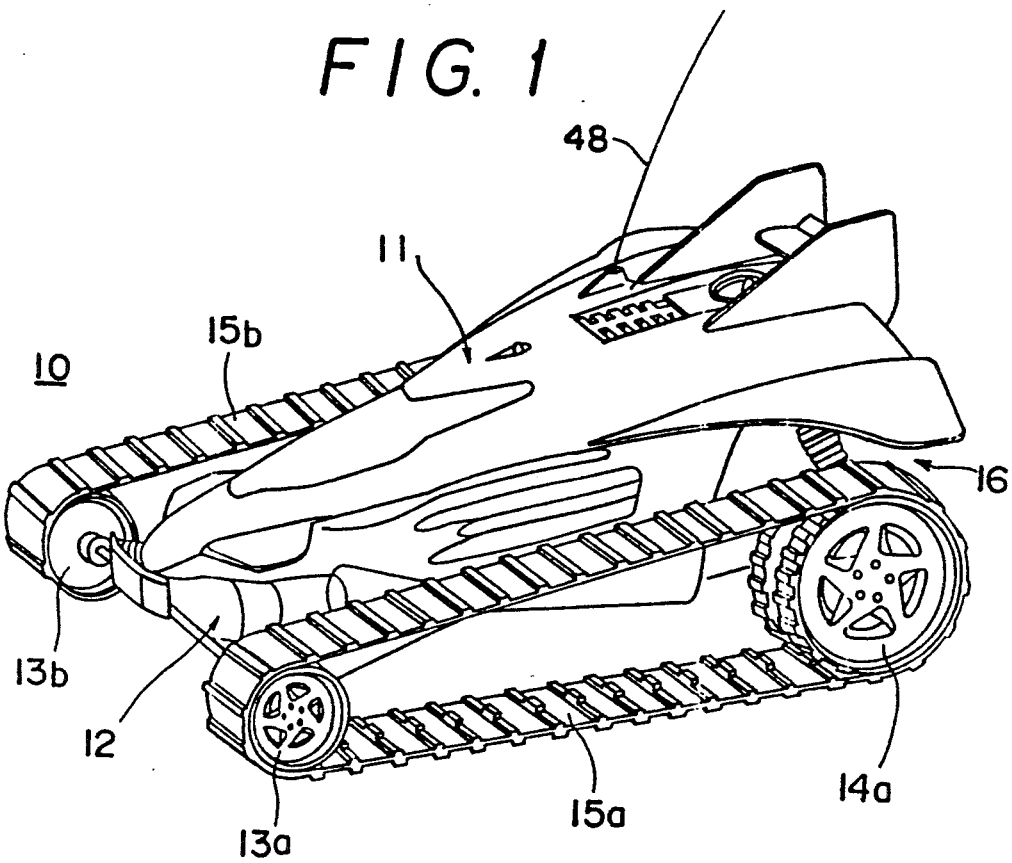
FIG. 1 is a perspective view of a vehicle toy according to an embodiment of the present invention.

In the drawings, like reference characters indicate like parts. A preferred caterpillar-type vehicle toy indicated generally at 10 comprises a body 11, which forms the upper portion of the vehicle, and a chassis 12 which forms the lower portion of the vehicle and supports the body 11. Left and right front wheels 13*a* and 13*b* are provided on the chassis, generally at the front, on opposite sides of the chassis, and left and right rear wheels 14*a* and 14*b* are provided on the chassis, generally on opposite sides at the rear of the chassis. Left and right caterpillars 15*a* and 15*b* are engaged over the front and rear wheels respectively on the left and right sides. A driving section indicated generally at 16 is provided, preferably generally in the rear of the chassis 12, over the rear wheels 14, for separately and independently driving the left and right caterpillars 15*a*, 15*b* through the left and right rear wheels 14*a*, 14*b*, respectively.

The body 11 and the chassis 12 are made of, for example, plastic or any other suitable material. The depicted body 11 is formed into a streamlined shape which has a front end sharp or somewhat pointed in plan and side elevation views, and a width and height gradually increasing toward the rear end. The body 11 further is preferably provided with stabilizer means at the rear, which may be as depicted or another arrangement of one or more horizontal and/or vertical wings and/or fins for appearance, stability or both, although stabilizing effects will not appear until sufficiently high speeds are attained. The body could be in the form of other aerodynamic styles or various conventional passenger car, truck and other conventional vehicle styles.

Figure 3:
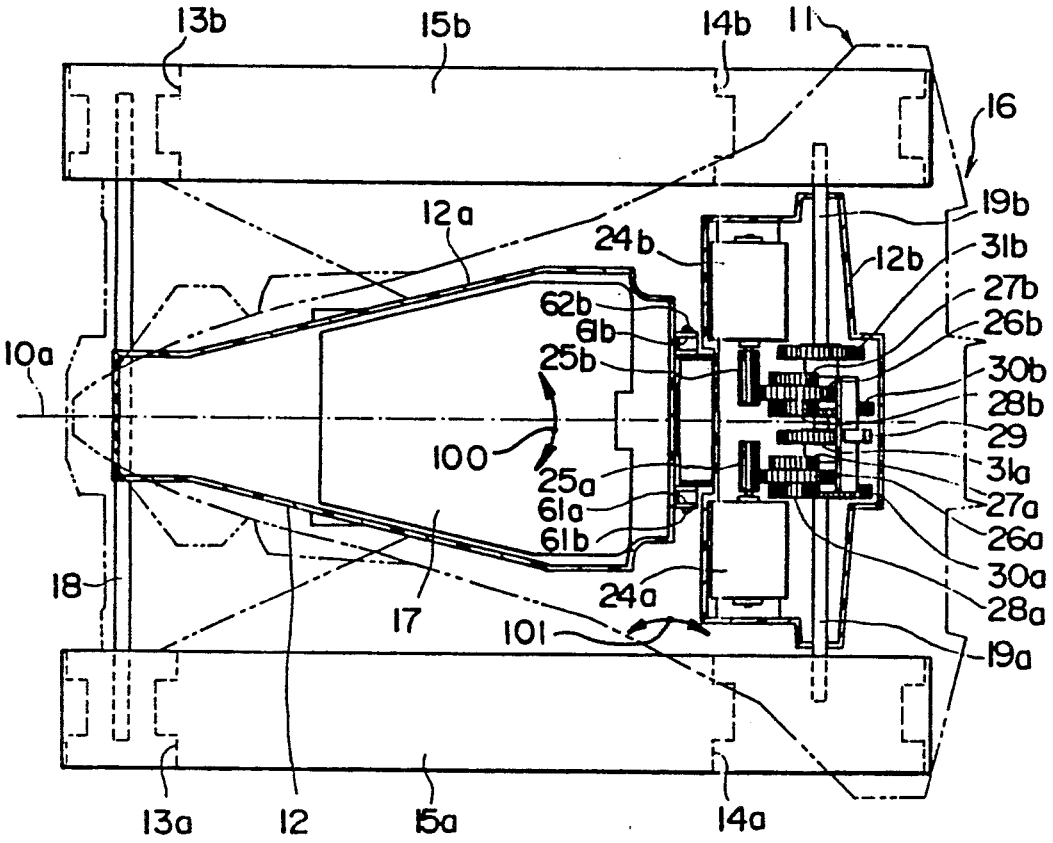
FIG. 3 is a plan view of the same vehicle toy with the body indicated in phantom for clarity.

Preferably, the chassis 12 is provided in separate front and rear portions 12*a* and 12*b*, respectively. The front portion chassis 12*a* preferably includes a substantially box-like housing which also forms part of the lower frame of the vehicle body. A receiving substrate or circuit board 17 (indicated in phantom), provided with integrated radio signal receiving and processing circuitry as described below or the like, preferably is mounted to the chassis 12, preferably within the box-like housing of the chassis front portion 12*a* for protection. The rear chassis portion 12*b* preferably includes a hollow housing at least partially containing the driving section 16. The front chassis portion 12*a* preferably also houses a suitable power supply, preferably a rechargeable battery or battery pack 12'. The driving section 16 preferably includes first and second electric motors 24*a*, 24*b* (see FIG. 3) and reduction transmissions or other speed-reduction mechanisms for separately drivingly coupling the motors 24*a*, 24*b* to the left and right rear wheels 14*a*, 14*b*, respectively. Power supply 12, powers both the circuitry of board 17 and the motors 24*a*, 24*b*.

Figure 4:
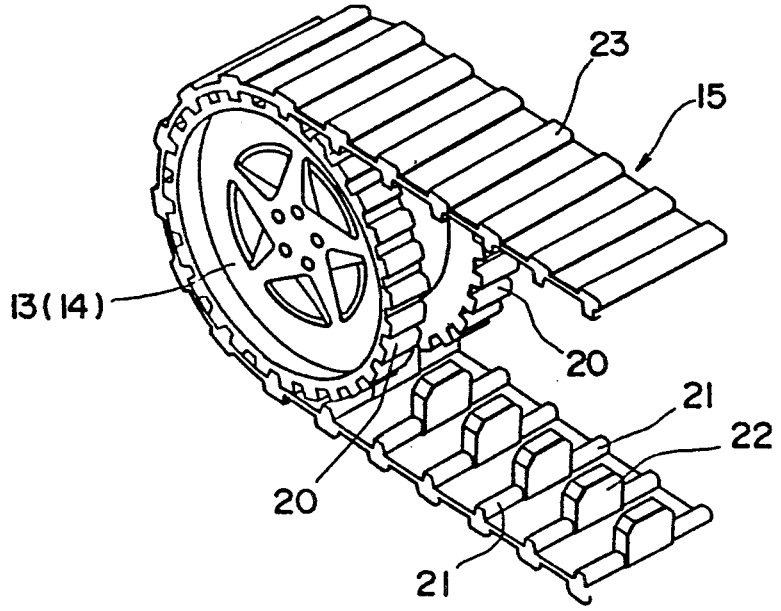
FIG. 4 is a perspective view of a caterpillar portion of the same vehicle toy.

Each of the front wheels 13*a*, 13*b* and rear wheels 14*a*, 14*b* is preferably molded of a plastic material or the like, and each has formed around its periphery, two axially or widthwise spaced-apart sections or rings of teeth 20, 20. The widthwise spacing apart by a predetermined distance of the two sections of teeth 20, 20 can be seen in FIG. 4. The rear wheels 14*a*, 14*b* preferably each have a diameter greater, preferably at least fifty percent greater, than that of the front wheels 13*a*, 13*b*, as clearly illustrated in FIGS. 1 and 2, to lower the front end and center of gravity of the vehicle 10 and reduce the possibility of the vehicle flipping over when traversing uneven ground in high-speed running operation. The two front wheels 13*a*, 13*b* are rotatably mounted on opposite ends of a front shaft 18. Shaft 18 is mounted near the bottom of the front portion 12*a* of the chassis 12 extending perpendicularly to a central longitudinal axis 10*a* of the vehicle.

The rear wheels 14*a*, 14*b* are respectively mounted on outboard shaft ends of left and right rear drive shafts 19*a*, 19*b*, which are provided so as to horizontally project from the sides of the rear portion 12*b* of the chassis 12 housing the driving section 16. The front wheels 13*a*, 13*b* are mounted so that the front or forward-most portions thereof are spaced slightly ahead of all of the remainder of the vehicle 10.

Each of the left and right caterpillars 15*a*, 15*b* is preferably made of a rubber composition or other flexible and slightly elastic material and is in the form of an endless, continuous, annular belt having inner and outer major circumferential sides joined by narrow annular edges. Preferably, each caterpillar 15*a*, 15*b* has on its inside or inner circumferential side, a series of parallel, teeth-like projections. The projections preferably include two laterally spaced-apart "rows" of "teeth" 21, 21, which are spaced to engage with the two sections of teeth 20, 20 formed on each of the wheels. A third, central row of "teeth" 22, higher than the two outer rows of teeth 21, 21, is formed between the two rows of teeth 21, 21 so as to be opposite the central groove or like space provided circumferentially around each wheel 13*a*, 13*b*, 14*a*, 14*b* between the laterally spaced-apart sections of wheel teeth 20, 20. Preferably, the projections of teeth 22 of the third row are "higher", that is, extend farther from the inner circumferential surface of each caterpillar 15*a*, 15*b*, than do the adjoining teeth 21, 21 and extend into the circumferential grooves provided on each of the wheels to laterally engage the caterpillar with the receiving wheels. Also, preferably opposing sides of each of the teeth 22 of the third row 22 are chamfered or tapered together side to side and front to rear, at the uppermost free end of each tooth 22, as the tooth 22 extends away from the adjoining inner surface of the caterpillar and the adjoining teeth 21, 21. This tapering appears to reduce the likelihood of the teeth 22 climbing out of the wheel grooves in which they are received and disengaging the caterpillars from the wheels.

Preferably, each caterpillar has projecting from its outside or outer circumferential surface a row of substantially uniformly sized, shaped and spaced generally parallel ground-engaging members 23. Preferably, each of these members 23 extends in the widthwise or lateral direction of the caterpillar. Preferably, the members are integrally formed with the caterpillar at the same pitch as the pitch of the rows of inside projections 21, 21, 22.

The rearwardly located driving section 16 preferably contains separate first and second (left and right) motors 24*a* and 24*b* which are separately controlled and independently drivingly connected to the left and rear wheels 14*a*, 14*b* to separately transmit driving forces to the rear wheels 14*a*, 14*b*, respectively, through separate speed reduction mechanisms, preferably separate reduction gear transmissions. Preferably, the two motors 24*a*, 24*b* are disposed on opposite sides of the rear portion 12*b* of the chassis 12 with their output shafts extending generally horizontally and colinearly towards each other. Relatively long pinions 25*a*, 25*b* are respectively located on the inwardly extending ends of these output shafts (see FIG. 3). The control terminals of the motors 24*a*, 24*b* are respectively electrically connected to predetermined positions on the receiving substrate 17 so that the driving of each of the motors is independently controlled, as described below. The reduction transmissions preferably include left and right intermediate gears 26*a*, 26*b*, which are respectively engaged with the pinions 25*a*, 25*b*, and large and small gears 27*a*, 28*a* and 27*b*, 28*b*, which are integrally provided on both sides of the intermediate gears 26*a* and 26*b*, respectively. The left and right intermediate gears 26*a* and 26*b* are horizontally slid by a gear shift lever 29, by forks extending from the lever and around the sides of gears 26*a* and 26*b*, while being kept in engagement with the left and right pinions 25*a*, 25*b*, respectively. The preferred reduction transmissions further include left large and small gears 30*a*, 31*a* and right large and small gears 30*b*, 31*b*, which are provided on the at least substantially co-linear left and right rear drive shafts 19*a* and 19*b*, respectively. When the intermediate gears 26*a*, 26*b* are slid to the left side by the gear shaft lever 29 (the state shown in the drawing), the left and right gears 28*a* and 28*b* engage in mesh with the gears 30*a* and 30*b*, respectively. When the intermediate gears are slid to the right side, the left and right gears 27*a* and 27*b* engage in mesh with the gears 31*a* and 31*b*, respectively. The left and right reduction mechanisms can be simultaneously switched to a low-speed side or a high-speed side by manually horizontally sliding the single gear shift lever 29 to change the gear ratios of the reduction transmission mechanisms between relatively higher reduction gear ratios and relatively lower reduction gear ratios. Preferably, the rear wheels 14*a*, 14*b* are keyed with the outer ends of the shafts 19*a* and 19*b* to withstand the output torque but the wheels 14*a*, 14*b* can be only frictionally secured to the shafts if desired. Low speed is suggested for increased battery life and for greater torque when climbing steep inclines or running extremely rough surfaces.

Figure 5:
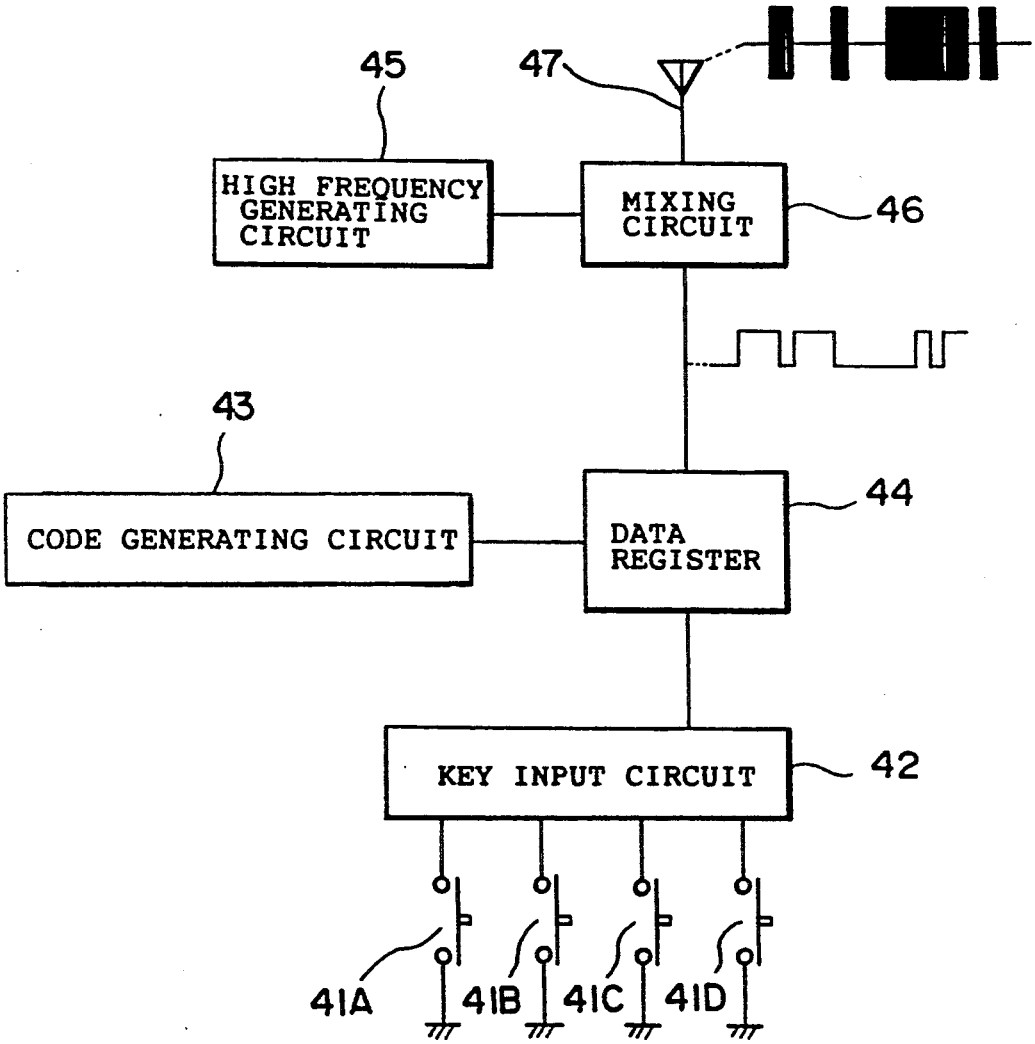
FIG. 5 is a block diagram illustrating transmitter circuitry of the embodiment of the present invention.
Figure 6:
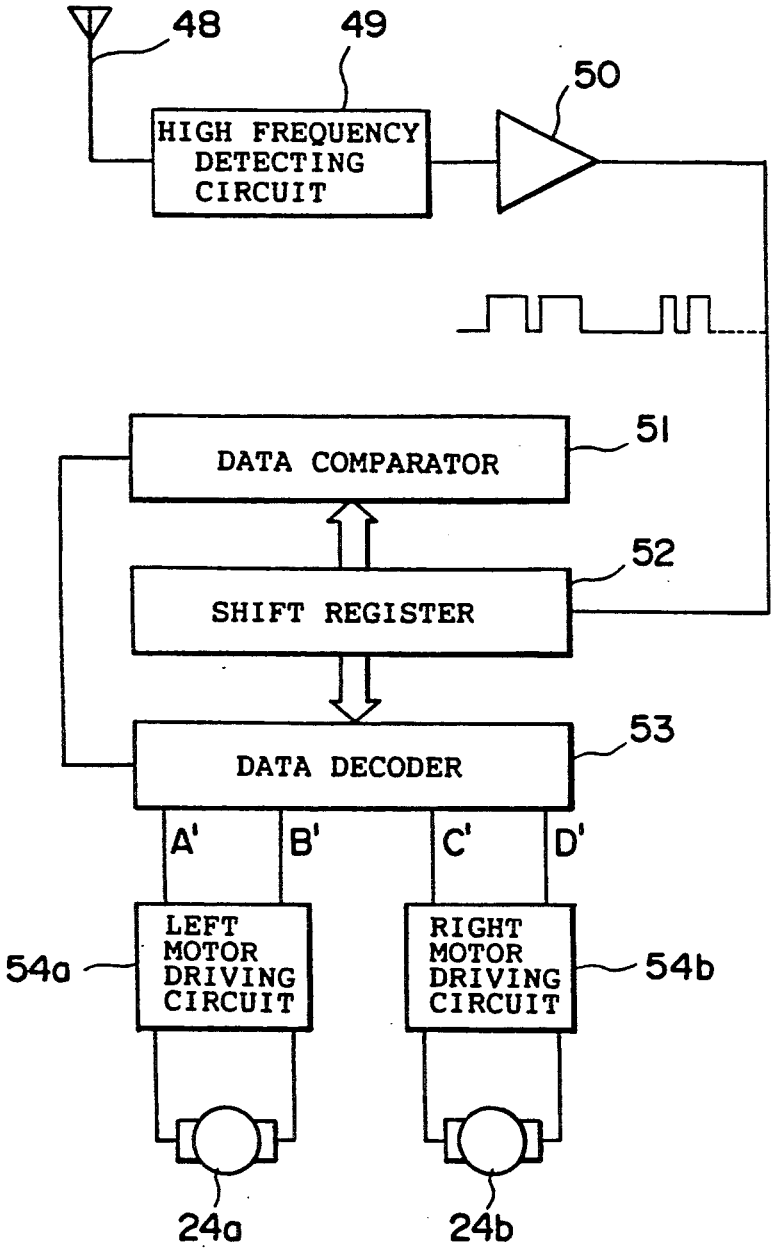
FIG. 6 is a block diagram illustrating receiver circuitry of the embodiment of the present invention.

FIG. 5 is a block diagram showing a presently preferred transmitter circuit of the embodiment of the present invention, and FIG. 6 :s a block diagram showing a presently preferred receiver circuit of the same embodiment.

Preferably, the transmitter circuit of FIG. 5 is part of a separate, portable transmitter unit 40 while the receiver circuit of FIG. 6 is provided on the receiver substrate 17 in a conventional manner to form a radio-control system for the vehicle toy 10. Preferably the system employs pulse position modulation and a bit detection method using a synchronous digital signal for a decoder or the like for individual motor control. In the control system, operator control signals are generated from the movement of left and right control sticks (not shown) of the transmitter unit 40 and are transmitted by the transmitter unit 40 as a radio-control signal. The radio signal is received by the receiver unit in the vehicle toy 10 so that the left and right motors 24*a*, 24*b* can be separately controlled.

In the transmitter circuit shown in FIG. 5, reference numerals 41A, 41B and 41C, 41D are switches in the transmitter unit, which are respectively turned on and off in linkage with left and right channel control sticks of the transmitter unit (neither depicted). A key input subcircuit 42 detects the ON/OFF states of the switches 41A, 41B, 41C and 41D and is connected to a data register 44 to which a code generating subcircuit 43 is also connected. The data register 44 outputs to a mixing subcircuit 46 which also receives input from a high frequency generating subcircuit 45. The output from mixing subcircuit 46 is supplied to a transmitter antenna 47. The unit 40 also includes a battery with circuitry generating appropriate voltages in a conventional fashion, which are omitted from the figure for clarity. For example, where the switch 41A of the switches 41A, 41B (which are both controlled with the left channel control stick) is turned on, the left motor 24*a* is directed to rotate normally in a forward drive direction; when the other switch 41B is turned on, the motor 24*a* is directed to rotate normally in a reverse drive direction. When both switches 41A, 41B are turned off, the motor 24*a* is directed to stop. Both switches 41A, 41B are controlled by a single control stick (not depicted) and may not be simultaneously turned on. This switching procedure also applies to the right switches 41C, 41D which control the right motor 24*b*.

In the vehicle circuitry shown in FIG. 6, reference numeral 48 denotes a receiver antenna preferably extending outside the vehicle body 11; reference numeral 49, a receiver circuit for high-frequency amplification and detection; reference numeral 50, an amplifier circuit; reference numeral 51, a data comparator; reference numeral 52, a shift register; reference numeral 53, a data decoder; and reference numerals 54*a* and 54*b*, separate motor driving circuits connected to the left and right motors, 24*a* and 24*b*, respectively, for independently operating the left and right motors 24*a* and 24*b*, respectively. These various circuits and circuit elements are interconnected as illustrated in FIG. 6. Again, the battery 12, and circuitry for generating the appropriate voltages for the receiver unit and powering the motors 24*a* and 24*b* are omitted as being conventional and known in this art.

The left and right switches 41A, 41B and 41C, 41D are respectively turned on and off by operating the control sticks provided in the transmitter unit (neither depicted) of the system. When the key input circuit 42 detects the ON/OFF state of a switch, the corresponding code is set in the data register 44 by the code generating circuit 43 in accordance with the ON/OFF state detected. The output from the data register is mixed with the carrier wave generated from the high frequency generator circuit 45 in the mixing circuit 46, and the output from the mixing circuit 46 is sent to the transmitter antenna 47 for transmission as the radio-control signal. The radio-control signal is received by the receiver antenna 48 and demodulated to a serial signal, which corresponds to the signal output from the data register, by the high frequency amplifying/detecting circuit 49 and the amplifier circuit 50. The serial signal is output to the shift register 52. The serial signal is converted into a parallel signal in the shift register 52, compared with a predetermined frequency in the data comparator 51 and then output as a parallel signal to the data decoder 53. The data decoder 53 produces an output corresponding to the operating state of the switches 41A, 41B, 41C and 41D. The output is sent to the left and right driving circuits 52*a*, 54*b* so that the left and right motors 24*a*, 24*b* are separately controlled to forwardly rotate, reversely or stop in correspondence with the operation of the transmitter unit control sticks.

An example of the operation of this vehicle toy is described below. When both the left and right motors 24*a*, 25*b* are rotated for forward movement by appropriately operating the control sticks associated with the radio-control transmitter unit 40, the rear wheels 14*a*, 14*b* are forwardly rotated through the pinions 25*a*, 25*b*, the intermediate gears 26*a*, 26*b*, the gears 28*a*, 28*b*, the gears 30*a*, 30*b*, and the rear shafts 19*a*, 19*b*, respectively, so effecting forward driven movement of the caterpillars 15*a*, 15*b*. This driven movement of the caterpillars 15*a*, 15*b* in turn also causes the normal (forward) rotation of the front wheels 13*a*, 13*b*. Since all the four wheels are driven to normally rotate, the vehicle toy is forwardly moved on the caterpillars. At this time, the two side-by-side rows of teeth 20, 20 of the rear wheels 14*a*, 14*b* and the front wheels 13*a*, 13*b* engage with the internal projection rows 21, 21 of the caterpillars 15*a*, 15*b*, respectively. The central projection portions 22 fit and transversely engage in the central groove between the pairs of gear teeth 20, 20 so that the caterpillars 15*a*, 15*b* are prevented from separating transversely from the wheels. The vehicle toy is backwardly moved by reversing both of the left and right motors 24*a*, 24*b* by the same operation as that described above. When one of the motors is normally rotated so that its caterpillar is moved, while the other motor is stopped, the direction of movement of the toy can be changed without using any steering mechanism. The vehicle toy can be rotated in place more quickly, with a zero turning radius, by simultaneously forwardly rotating one of the motors and reversing the other motor. The vehicle 10 is believed to be unique in its capability to literally spin about its center at high speed. In addition, high-speed running and low-speed running can be switched by manually switching the reduction transmission mechanisms using the gear shift lever 29.

The vehicle toy 10 can be freely operated so that the left and right motors 24*a*, 24*b* on the receiver side are separately and independently forwardly rotated, reversely rotated or stopped by the operation of the left and right control sticks or the like on the transmitter side. In addition, the left and right motors 24*a*, 24*b* are directly connected to the left and right rear wheels 14*a*, 14*b*, respectively, through the speed reduction mechanisms, and the left and right rear wheels 14*a*, 14*b* are connected to the front wheels 13*a*, 13*b* through the caterpillars 15*a*, 15*b*, respectively, so that all four wheels are driven. It is possible to obtain the same high-speed performance as that of a conventional four-wheel drive car by this simple structure. The provision of the caterpillars 15*a*, 15*b* causes an increase in the ground contact area, as compared with a four wheel car, and prevents the vehicle toy from sinking in a soft off-road location such as in sand, grass or the like, thus resulting in increased ability to run uninterruptedly on a wide variety of off-road surfaces.

Preferably, in this embodiment, nothing projects from the front end of the vehicle body 11 or chassis 12 forwardly of the front wheels 13*a*, 13*b*. The surfaces of the caterpillars 15*a*, 15*b* placed on the front wheels 13*a*, 13*b*, respectively, are positioned at the extreme front end of the vehicle body without any cover. Thus, when there is a broad obstacle in front of the vehicle, this obstacle will be contacted by the front portion of one or both caterpillars. The vehicle toy can climb over the obstacle by the frictional force generated on the support surface which forwardly moves the toy and the frictional force generated by the front ends of the caterpillars pushed against the obstacle to lift the toy.

Figure 2:
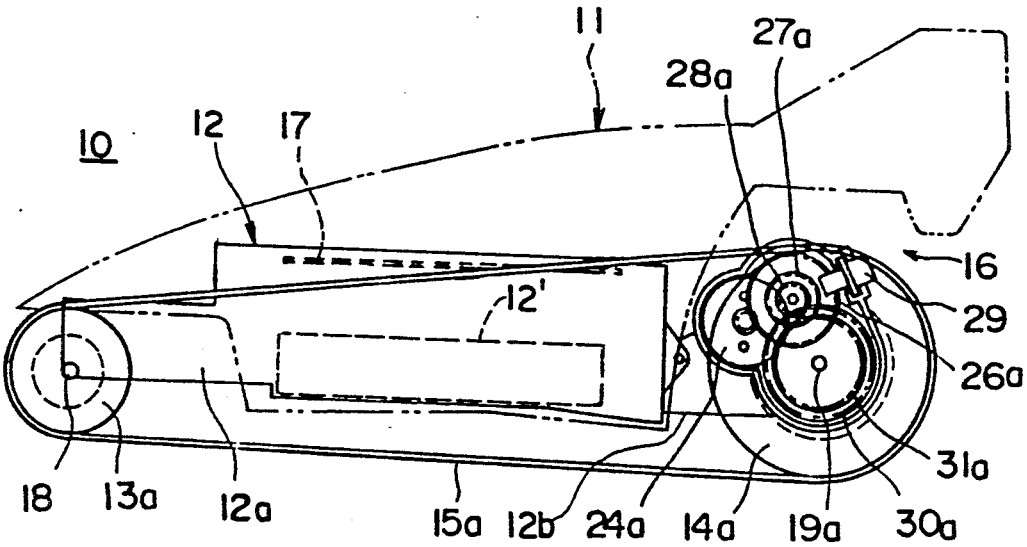
FIG. 2 is a side view of the same vehicle toy with the body indicated in phantom for clarity.
Figure 7:
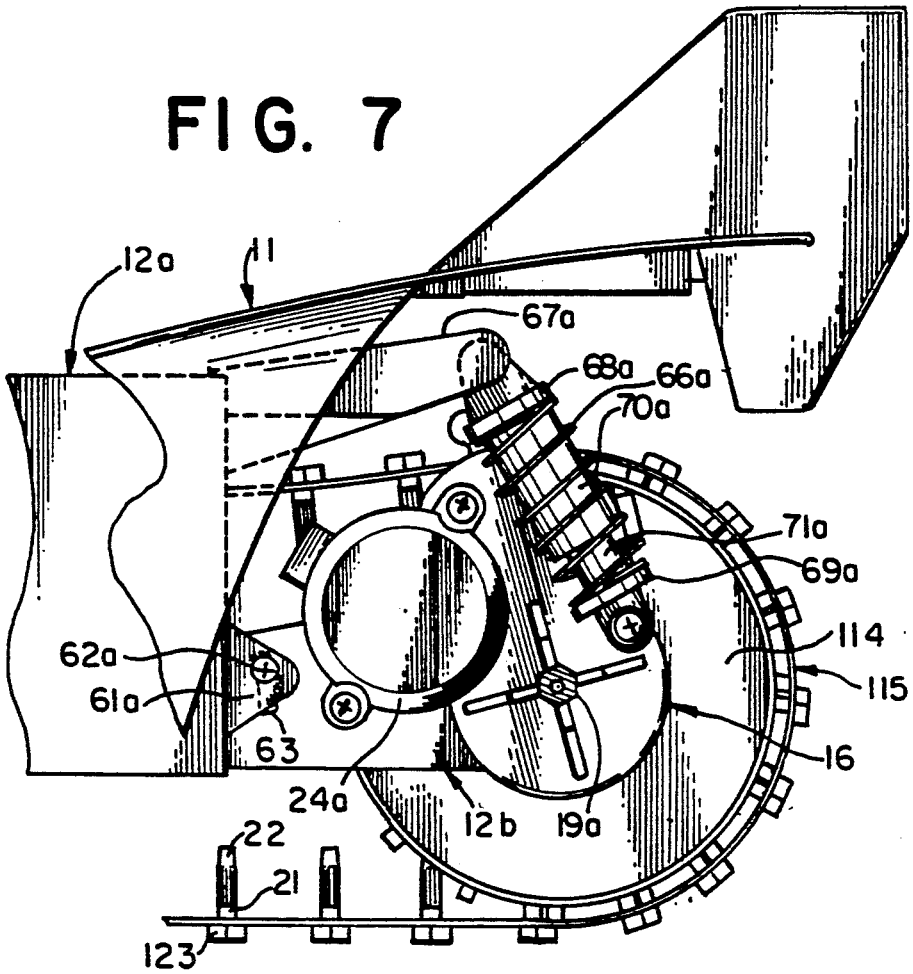
FIG. 7 is a detailed, partially broken away, view of the rear portion of the vehicle and the articulate coupling between front and rear portions of the chassis and further illustrating alternate caterpillar and rear drive wheel configurations.

The articulate coupling between the front and rear chassis portions 12*a* and 12*b* is indicated in FIG. 1 and is better seen in FIG. 7. Left ear 61*a* protrudes rearwardly from the extreme rear vertical wall of the forward portion 12*a* of the chassis. A generally box-like structure at the forward end of the rear portion 12*b* of the chassis is received between left ear 61*a* and a mirror right ear 61*b* (see FIG. 4). Left and right pivots 62*a*, 62*b* are provided, preferably by screws, pins or the like passed through each ear 61*a*, 61*b*, respectively, and into the box-like structure of the forward end of the rear chassis portion 12*b*. Preferably, pivots 62*a* and 62*b* are received in elongated slots, a left one of which is indicated (partially in phantom) at 63 in FIG. 7. Left slot 63 and its mirror-image right slot (not depicted) permit partial pivotal movement between the front and rear portions 12*a*, 12*b*, respectively, and the supported pairs of front and rear wheels about longitudinal axis 10*a* extending front to rear through the vehicle, as indicated by the curved, double arrow headed line 100 in FIG. 3, and partial pivotal movement of the front and rear portions 12*a*, 12*b* about an axis extending perpendicularly to the longitudinal axis 10*a*, through the pivots 62*a*, 62*b*, as indicated by the curved, double arrow headed line 101 in FIG. 3. Some small pivotal movement might also be allowed about an axis perpendicular to the previous two axes. This articulation of the chassis 12 permits the vehicle 10 to better absorb shocks, for example from falling, and to keep all four of the wheels on the ground as much as possible when traversing an uneven surface. It also may be of some assistance, on occasion, in mounting the caterpillars to the wheels. The toothed cog drive and tooth/groove engagement between the caterpillars and the drive wheels also allow the caterpillars to be loosely mounted to the wheels for increased safety and reduced friction and operating loads on the driving elements.

Preferably, means are further provided for biasing the rear chassis portion 12*b* towards a predetermined orientation, namely downwardly, with respect to the front chassis portion 12*a* and to absorb shocks between the articulated chassis portions 12*a*, 12*b*. Preferably, the means includes a pair of substantially identical coil springs, one of which is depicted in FIG. 7 at 66*a*. A suspension arm 67*a* extends generally rearwardly and upwardly over the rear chassis portion 12*b*. An extreme rear end of the arm 67*a* is formed into a first seat 68*a* receiving one end of spring 66*a*. A separate, second seat 69*a* is preferably coupled to the rear housing portion 12*b* to receive the remaining end of the spring 66*a*. Preferably, a pair of telescoping members 70*a* and 71*a* are provided within the coils of spring 66*a*, attached to the first seat 68*a* of the suspension arm 67*a* and to the second seat 69*a*, respectively, to assist in maintaining the spring 66*a* in position between the arm 67*a* and seat 68*a*. If desired, a suitable material can be provided for interaction with telescoping members 70 and 71*a* to more quickly dampen relative movement of the rear chassis portion 12*b* with respect to the front chassis portion 12*a*. The limited pivotal movement provided by the articulated coupling and the significant height of the central row of projections, or teeth 22, for example, 1 cm tooth height with about a 4 cm diameter front wheel 13*a*, 13*b*, together with other factors to be discussed, prevent the caterpillars from disengaging from the wheels, even during high speed operation with sudden changes in motor rotation direction.

Figure 8:
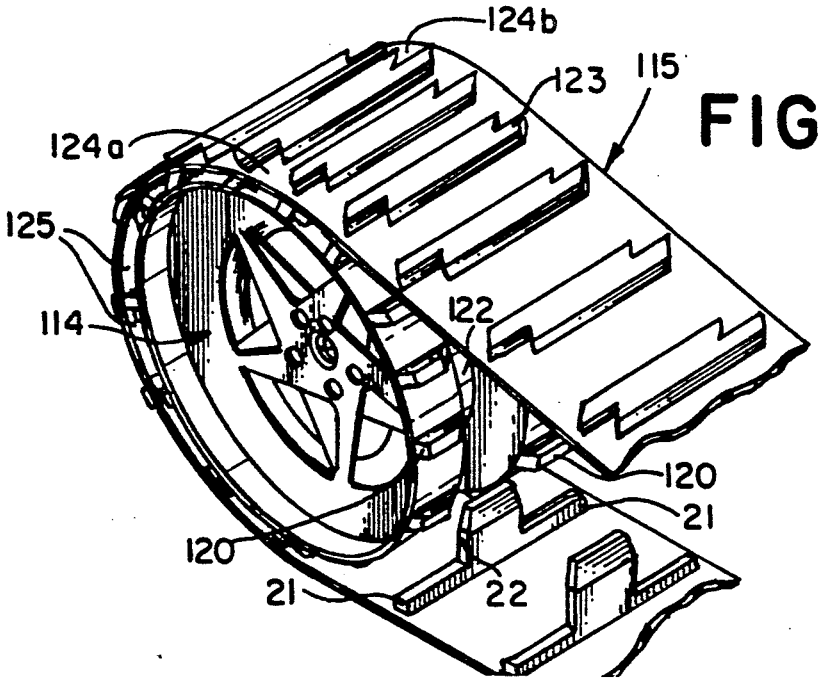
FIG. 8 is a perspective view of the alternate caterpillar and rear drive wheel configurations.

FIGS. 7 and 8 depict a presently preferred, alternate configuration of a caterpillar 115 and a rear driving wheel 114 for the vehicle 10. Like the original caterpillars 15*a* and 15*b*, alternate caterpillar 115 is made of a rubber-based or other suitably flexible and slightly elastic composition, and is in the form of an unreinforced, endless annular belt having on the major inside or inner circumferential side, the two laterally spaced-apart rows of projections or teeth 21, 21 and a third noticeably higher central row of projections or teeth 22. The projections 22 are again formed between the two spaced rows of projections 21 so as to fit into a central groove 122 provided circumferentially around the rear wheel 114 between axially spaced-apart sections of radially outwardly protruding teeth 120, 120 provided on the wheel 114.

Ground-engaging members 123 are formed projecting on the outside or outer circumferential surface of the caterpillar 115. These members 123 extend generally widthwise transversely across the caterpillar 115 and preferably are formed at the same pitch as the inside teeth 21, 21 and 22. Unlike the original projections 23, the modified projections 123 are preferably of a general "Z" shape and rise generally perpendicularly from the outer circumferential surface of the caterpillar. As can be seen, the "Z" shape causes each member 123 to vary in length (i.e. "front" to "back" dimension) as each member extends from one side edge of the outer circumferential surface of the caterpillar to the opposing side edge. Each member is provided by two generally parallel, but slightly tapering linear portions which extend from opposing edges of the outer circumferential surface towards one another and overlap integrally in a central area of the outer surface. A slight reducing taper provides a reduction in length dimension of the members 123 as each member extends from the central area of overlap towards the each of the opposing edges of the surface. Each linear portion is more severely tapered down, proximal to each of the two edges of the outer circumferential surface, to further reduce the length of each projection 123 at each of the opposing edges. The "Z" shape also provides wedge-shaped recesses 124*a* and 124*b* facing both the forward and rearward turning directions of the caterpillar 115 which can engage portions of a soft surface over which the vehicle might ride. Members 123 appear to provide significantly better gripping power in both forward and reverse movement than do the smaller, substantial rectangular type projections 23 of the first embodiment caterpillar 15. On the other hand, the relative reduced size of the projections 123 proximal each side edge of the caterpillar 115 appears to reduce forces on the caterpillar 115, when the vehicle 10 is turning, which tend to pull the caterpillar 115 laterally from the wheels. The improved gripping power may be the result of height (total height approximately 2 mm), increased length (approximately 6 mm) and resulting stiffening of each member in the area of overlap at the center of each projection 123, the provision of recesses 124*a*, 124*b* of the "Z" configuration, or possibly a combination of these features.

Driving wheel 114 differs slightly from the earlier described wheels 14*a*, 14*b* in that the teeth 120 of the wheel 114 are also provided at the same relatively wide pitch or spacing as the caterpillar projections 21, 21, 22, and are, with the projections 21, 22, 21 sufficiently thin so that circumferential spaces 125 are provided between the caterpillar 115 and portions of the outer circumferential surface of the driving wheel 114 wrapped by the caterpillar 115, in areas not occupied by either the teeth 120 or the projections 21. Spaces 125 or like spaces reduce the instances of grass and other material typically encountered in operation of such vehicle toys from becoming trapped between the caterpillar and the driving wheel. It was found in high-speed operations of the vehicle 10 with wheels 13, 14 and caterpillars 15, which have closer, more gear-like spacing and engagement than do wheels 114 and caterpillars 115, that grass caught between the wheel(s) and the caterpillar could cause the vehicle 10 to stick or would be torn up by the vehicle. Providing circumferential spaces 125 reduces the surface area between the caterpillar 115 and wheel 114 in which grass, rug pile or the like might get caught.

It also has been found possible to eliminate teeth 20 on the non-driving front wheels 13*a*, 13*b* of the vehicle toy and to simply provide smooth cylindrical surfaces, for example, without adverse effect on vehicle performance. However, the central circumferential groove should be maintained around the non-driving front wheels to receive the central row of projections 22 and laterally engage the caterpillar 15, 115 on the front wheels. The two rows of outer projections 21 of the caterpillars can be supported on the generally smooth, circumferential surfaces of the non-driving front wheel, on either side of its central groove, to space the caterpillar 15 or 115 from the front wheel where the front wheels are wrapped by the caterpillars. Alternatively or in addition, projections can be provided within the grooves of the front or rear wheels 13, 14, 114 or both for cog engagement with the central projections 22 of the caterpillars although such engagement has not been found necessary.

As described above, the caterpillars are wrapped over the front and rear wheels provided on the left and right sides of the body of the vehicle toy so that the left and right wheels are separately driven. Preferably, the caterpillars 15, 115 or the like are sufficiently loosely fitted to the wheels and sufficiently supple to permit the caterpillar to be slipped over the front and rear wheels without disassembly of the wheels or belt, when the caterpillar is engagedly mounted on the front and rear wheels. Caterpillars of the present invention can be sufficiently loosely fitted and supple to provide some protection and lessen the likelihood of possible injury if an operator should get a finger caught between a wheel and a caterpillar.

A presently preferred material for molding monolithic, unreinforced caterpillars for the present invention is a thermoplastic elastomer compound developed by Aronkasei Co., Ltd., of Japan, which is mainly styrenic and butadienic copolymer. The currently preferred formulation is designated AR-481B by Aronkasei and is strong and light but supple and somewhat elastic.

The present invention thus permits the attainment of the ability to run at a high speed equal to that of a four-wheel drive vehicle toy and an increase in the ground contact area, due to the caterpillars, allowing the vehicle toy to run at high speeds on various off-road surfaces.

The above-described embodiments, of course, are not be construed as limiting the breadth of the present invention. For example, although it is preferred that the left and right rear wheels 14*a*, 14*b* are respectively driven by the left and right motors 24*a*, 24*b*, the left and right front wheels 13*a*, 13*b* or alternate front and rear wheels 13*a*/14*b* and 13*b*/14*a* could be driven. In the control system, the forward and reverse rotational speeds need not be constant. The rotational speed could be controlled to vary continuously or in steps. The shapes of the body 11, the chassis 12, the wheels 13 and the caterpillars 15 are not limited to the shape of the depicted embodiment. While one-piece wheels 13*a*, 13*b*, 14*a*, 14*b* with central grooves are preferred, annular members can be provided adjoining one another and configured and/or spaced to provide a central groove therebetween. The positions of the teeth-like projections 21/22/21 and the rows of gear teeth 20, 20 and the central groove of each wheel can be reversed. While each set of adjoining projections 21/22/21 are preferably integrally and monolitically formed with one another as a single widthwise extending member of uneven height, separate adjoining individual teeth could be provided projecting from the inner circumferential surface of each caterpillar. While twin electric motors are preferred, single or twin motors or gasoline engines could be substituted. While gear reduction transmissions are preferred, other reduction drives including belt drives, hydraulic drives and continuously variable automatic transmissions could be substituted. Other modifications, and other alternative constructions will be apparent, which are within the spirit and scope of the invention as defined in the appended claims.

We claim:

1. A vehicle toy comprising:

a vehicle chassis having separate front and rear portions and having right and left sides having a longitudinal axis;

right and left front wheels mounted on said chassis front portion;

right and left rear wheels mounted on said chassis rear portion;

a single right caterpillar and a single left caterpillar each engaged over said front and rear wheels respectively on said right and left sides, said chassis being supported by said right and left front and rear wheels and caterpillars;

first and second motors driving each of said right and left caterpillars independently of one another through said wheels; and an articulate coupling between said front and rear chassis portions providing at least some pivotal motion of said front and rear chassis portions with respect to one another while said vehicle toy is being operated, the articulate coupling permitting partial relative pivotal movement of the front and rear portions of the chassis with respect to one another both about an axis extending orthogonally to said longitudinal axis and laterally about said longitudinal axis.

2. The vehicle toy of claim 1 further comprising:

a first reduction transmission between said first motor and said one of said right wheels;

a second reduction transmission between said second motor and said one of said left wheels;

each of said first and second reduction transmissions having a low gear ratio and a high gear ratio; and a common shift lever connected to both of said reduction transmissions and movable to simultaneously change both said reduction transmissions between said low gear and said high gear ratios.

3. The vehicle toy of claim 1 further comprising:

radio receiver mounted in the vehicle to receive a radio-control signal from a transmitter unit located remotely from said vehicle;

two motor driving circuits connected respectively to said first and second motors; and circuitry coupled with said receiver and configured to produce from said radio-control signal separate motor control signals for each motor driving circuit to separately and individually control said first and second motors.

4. The vehicle toy of claim 1 wherein the articulate coupling means permits relative pivotal movement of the front and rear portions partially about an axis extending perpendicularly to a longitudinal axis through the chassis.

5. The vehicle toy of claim 3 further comprising a means coupled between said front and rear chassis portions for biasing said rear chassis portion towards a lowermost pivoted position with respect to said front chassis portion.

6. The vehicle toy of claim 1 wherein each of said right and left rear wheels includes two sections of axially spaced peripheral teeth with a circumferential groove between said two sections of teeth; and wherein each caterpillar includes two laterally spaced-apart rows of internal teeth engaging with the two, axially spaced-apart peripheral teeth sections of said engaged rear wheel and a third row of inner teeth located between the two laterally spaced-apart rows of internal teeth, said third row of teeth projecting higher than said teeth of said two spaced-apart rows and engaging in said groove of said rear wheel.

7. A vehicle toy comprising:

a vehicle chassis having a front and rear and right and left sides;

right and left front wheels mounted on the chassis;

right and left rear wheels mounted on the chassis;

right and left caterpillars each engaged over the front and rear wheels respectively on the right and left sides, the vehicle chassis being supported on the right and left front and rear wheels and caterpillars;

first and second motors each drivingly coupled respectively to one of the right wheels and one of the left wheels;

each of said drivingly coupled right and left wheels including two sections of peripheral projecting teeth spaced apart axially, with a circumferential groove between said two sections of teeth; and each caterpillar including an inner circumferential surface, two laterally spaced-apart rows of internal teeth projecting from said inner circumferential surface, said two rows of teeth being spaced to engage said peripheral teeth of said two spaced-apart sections of said drivingly coupled wheel, and a third row of internal teeth projecting from said inner circumferential surface between said two spaced-apart rows of internal teeth, said internal teeth of said third row engaging in said groove of said drivingly coupled wheel.

8. The vehicle toy of claim 7 wherein said teeth of said two spaced-apart sections of each drivingly coupled wheel and said teeth of said two spaced-apart rows of each caterpillar are sized and spaced circumferentially with respect to said drivingly coupled wheel and said engaged caterpillar to provide circumferential spaces between each caterpillar and said two sections of said drivingly coupled wheel engaged by said caterpillar.

9. The vehicle toy of claim 8 wherein each remaining right and left wheels includes generally smooth, axially spaced-apart cylindrical surfaces receiving said internal teeth cf said two laterally spaced-apart rows of said engaged caterpillar and a central groove receiving said third row of internal teeth of said engaged caterpillar and wherein said laterally spaced-apart rows of teeth of said engaged caterpillar provide circumferential spaces between said two rows of teeth of said engaged caterpillar and said generally cylindrical circumferential surfaces of said engaged remaining wheel supporting said two rows of teeth.

10. The vehicle toy of claim 7 wherein at least a pair of opposing sides of each tooth of said third row taper toward one another at a free end of said third tooth as sad third tooth extends away from teeth of said two laterally spaced-apart rows adjoining each third tooth.

11. The vehicle toy of claim 10 wherein each caterpillar is sufficiently supple and sufficiently loosely fitted to said respective front and rear wheels engaged by said caterpillar to permit said caterpillar to be slipped over said front and rear wheels to engagedly mount said caterpillar on said respective front and rear wheels.

12. A vehicle toy comprising:

a vehicle chassis having a front and a rear and right and left sides;

first and second motors;

right and left rear wheels mounted on said chassis respectively drivingly coupled with said first and second motors to be separately driven thereby, each rear wheel including peripheral projecting teeth;

right and left front wheels rotatably mounted on said chassis;

right and left caterpillars respectively engaged over said right front and rear wheels and over said left front and rear wheels, said chassis being supported on said right and left front and rear wheels and caterpillars;

each of said caterpillars having internal teeth-like projections extending from an inner circumferential surface of said caterpillar and engaging with said peripheral teeth on said rear wheel;

said rear wheels being larger in diameter than said front wheels;

said peripheral teeth of each of said rear wheels comprising two teeth sections axially spaced apart with a circumferential groove therebetween;

each of said front wheels including a generally centrally located circumferential groove; and each of said internal teeth-like projections of each caterpillar comprising two laterally spaced-apart teeth with a third higher tooth therebetween, said higher teeth of each caterpillar engaging in the circumferential grooves of the respective front and rear wheels and said laterally spaced-apart teeth on each side of each higher tooth engaging with the axially spaced-apart peripheral teeth of the engaged rear wheel.

13. The vehicle toy of claim 12 wherein the rear wheels have a maximum diameter at least fifty percent greater than a maximum diameter of the front wheels.

14. The vehicle toy of claim 12 further comprising first and second reduction transmissions respectively coupling the first and second motors with said right and left rear wheels, each of said reduction transmissions contain shiftable gears for providing at least two different gear ratios, and a common gear shift lever connected to both said reduction transmissions for simultaneously shifting gears in said reduction transmissions to simultaneously change between said two gear ratios in each reduction transmission.

15. The vehicle toy of claim 12 wherein said axially spaced-apart peripheral teeth sections of each rear wheel and said laterally spaced-apart inner teeth of each caterpillar are respectively sized and spaced circumferentially with respect to said engaged rear wheel and caterpillar to provide circumferential spaces between adjoining engaged pairs of inner and peripheral teeth.

16. The vehicle toy of claim 15 wherein said laterally spaced-apart inner teeth of each caterpillar provide circumferential spaces between said caterpillar and portions of the front wheel engaged with said caterpillars and located on opposing sides of said groove of said front wheel.

17. A vehicle toy comprising:

a vehicle chassis having right and left sides and separate front and rear portions articulately coupled together;

first and second motors respectively separately drivingly coupled to a right side drive shaft and a left side drive shaft;

right and left rear wheels mounted respectively on said right and left side drive shafts to be separately driven thereby, each of said rear wheels including two axially spaced-apart sections of peripheral teeth and a circumferential groove between said teeth sections;

right and left front wheels rotatably mounted on opposite sides of said vehicle chassis front portion, each front wheel including a centrally located circumferential groove;

right and left caterpillars respectively engaged over said right front and rear wheels and over said left front and rear wheels;

each of said caterpillars having internal teeth-like projections including two rows of laterally spaced-apart teeth circumferentially engaging with said peripheral teeth on said rear wheels and a third row of teeth projecting higher from between said two laterally spaced-apart rows of teeth, teeth of said third row being received in the grooves of said engaged front and rear wheels;

said chassis being supported for running solely by said right and left front and rear wheels an caterpillars;

said rear wheels being larger in diameter than said front wheels;

a radio receiver mounted in said vehicle to receive a radio-control signal from a separate transmitter unit located remotely from said vehicle;

two motor driving circuits connected respectively to said first and second motors; and circuitry coupled with said radio receiver and configured to produce from said radio control signal separate motor-control signals for each of said motor driving circuits to separately and independently control said first and second motors.

18. The vehicle toy of claim 17 wherein at least a pair of opposing sides of each tooth of said third row taper toward one another at a free end of said third tooth as said third tooth extends away from teeth of said two laterally spaced-apart rows adjoining each third tooth.

19. The vehicle toy of claim 18 wherein each caterpillar is sufficiently supple and sufficiently loosely fitted to said respective front and rear wheels engaged by said caterpillar to permit said caterpillar to be slipped over said front and rear wheels to engagedly mount said caterpillar on said respective front and rear wheels.

* * * * *